US005242760A

United States Patent [19]

Matsuoka et al.

[11] Patent Number: 5,242,760

[45] Date of Patent: Sep. 7, 1993

[54] MAGNETIC RIBBON AND MAGNETIC CORE

[75] Inventors: Takashi Matsuoka; Toshikazu Furihata; Yasushi Ueda; Kazuhiko Suzuki; Masato Takeuchi, all of Ichihara, Japan

[73] Assignee: Mitsui Petrochemical Industries Ltd., Tokyo, Japan

[21] Appl. No.: 594,158

[22] Filed: Oct. 9, 1990

[30] Foreign Application Priority Data

| | | | |
|---|---|---|---|
| Oct. 9, 1989 | [JP] | Japan | 263516 |
| Oct. 9, 1989 | [JP] | Japan | 263518 |
| Oct. 9, 1989 | [JP] | Japan | 263519 |
| Oct. 9, 1989 | [JP] | Japan | 263520 |
| Oct. 9, 1989 | [JP] | Japan | 263521 |
| Oct. 9, 1989 | [JP] | Japan | 263522 |

[51] Int. Cl.[5] ..... B32B 15/00; H01F 3/00

[52] U.S. Cl. ..... 428/692; 428/402; 427/131; 336/206; 336/213; 336/219

[58] Field of Search ..... 428/900, 692, 402; 427/131; 336/206, 213, 219

[56] References Cited

U.S. PATENT DOCUMENTS

| | | | |
|---|---|---|---|
| 2,493,609 | 1/1950 | Young | 336/219 |
| 2,739,085 | 3/1956 | McBride | 336/234 |
| 4,677,023 | 6/1987 | Ishizaki et al. | 428/32.3 |
| 4,922,156 | 5/1990 | Turcotte | 315/244 |

FOREIGN PATENT DOCUMENTS 63-302504 12/1988 Japan .

*Primary Examiner*—Paul J. Thibodeau
*Assistant Examiner*—Stevan A. Resan
*Attorney, Agent, or Firm*—Nixon & Vanderhye

[57] ABSTRACT

Disclosed are a magnetic ribbon on at least one surface of which fine particles formed of a nonmagnetic inorganic substance having insulating properties are attached and a magnetic core around which this magnetic ribbon is wound or on which it is laminated. The fine particles serve as a spacer to form a layer of air between adjacent layers of the magnetic ribbon.

11 Claims, 14 Drawing Sheets

MAGNETIC RIBBON AND MAGNETIC CORE

BACKGROUND OF THE INVENTION

The present invention relates to a magnetic ribbon and a magnetic core formed by using said magnetic ribbon.

If a magnetic core is formed by winding or laminating a magnetic ribbon, and if insulation between layers of the ribbon is poor, an eddy current flowing across the ribbon layers occurs and an increase in eddy current losses results in an increase in overall core losses (magnetic losses). This tendency is particularly noticeable in the case of high frequencies. In addition, the frequency characteristics of permeability is poor, and it is impossible to expect any advantageous use at 100 kHz or more.

Accordingly, in order to improve insulation between ribbon layers, an insulating layer formed of a nonmagnetic material is conventionally provided between the ribbon layers, and a uniform insulating film is formed on the ribbon surface as one means thereof, so as to solve the aforementioned problem.

In cases where an amorphous magnetic ribbon is processed as a magnetic ribbon, annealing is usually carried out at 400° C. or thereabouts. However, if such annealing is carried out, because of a difference in the coefficient of linear expansion, i.e., since the coefficient of linear expansion of the insulating film is greater than that of the amorphous ribbon, compressive stress occurs in the ribbon, and magnetic characteristics deteriorate due to the adverse effect of magnetostriction.

In addition, there is another problem in that materials of such insulating films capable of withstanding annealing at 400° C. or thereabouts are limited. Furthermore, if a magnetic core is formed by providing an insulating film, the filling factor (space factor) declines, which disadvantageously causes the magnetic core to become large in size.

SUMMARY OF THE INVENTION

Accordingly, an object of the present invention is to provide a magnetic ribbon and a magnetic core having excellent magnetic characteristics while securing insulating properties between ribbon layers with a decline in the space factor set to a minimum, thereby overcoming the above-described drawbacks of the conventional art.

The present invention has been devised by first paying attention to the following point which serves as a theoretical premise.

In other words, as described above, at the time of producing a magnetic core by using a magnetic ribbon, an insulating film is generally interposed between ribbon layers, and the greatest matter of concern to those skilled in the art lies in finding an insulating material having an excellent insulating performance.

However, when viewed from a different perspective, even if such an insulating film is not present, if air is present between the layers, air would serve as an insulating layer and prevent an eddy current, and the space factor could be made as large as possible.

Therefore, in accordance with the present invention, there are provided a magnetic ribbon on at least one side of which fine particles formed of a nonmagnetic inorganic substance having insulating properties are attached, as well as a magnetic core having said ribbon wound therearound or laminated thereon.

In the present invention, as an initial object, the fine particles are attached so as to secure a layer of air.

However, cases are also conceivable in which fine particles are attached uniformly and densely on at least one surface of the ribbon. In this case, the significance of securing a layer of air does not exist, and the fine particles themselves function as an insulating layer. Nevertheless, in this case as well, it is possible to obtain the same effect as that obtained by securing a layer of air by means of the fine particles. Accordingly, the present invention provides a broad concept which includes both the case where the fine particles are attached coarsely and the case where they are attached densely.

In accordance with the present invention, fine particles formed of an inorganic substance are attached on at least one surface of the magnetic ribbon, so that if the magnetic ribbon is wound or laminated to form a magnetic core, the fine particles serve as a spacer, thereby forming a layer of air between adjacent layers of the ribbon.

In contrast, in cases where the magnetic particles are attached densely on at least one surface of the ribbon, the fine particles themselves serve as an insulating layer, as described above.

BRIEF DESCRIPTION OF THE DRAWINGS

The graphic charts shown in FIG. 1 to 3 illustrate the magnetic characteristics of the Experimental Example 1 in the Example 1 respectively. That is.

The graphic charts shown in FIG. 4 to 6 illustrate the magnetic characteristics of the Experimental Example 2 in the Example 1 respectively. That is.

Figure 11:
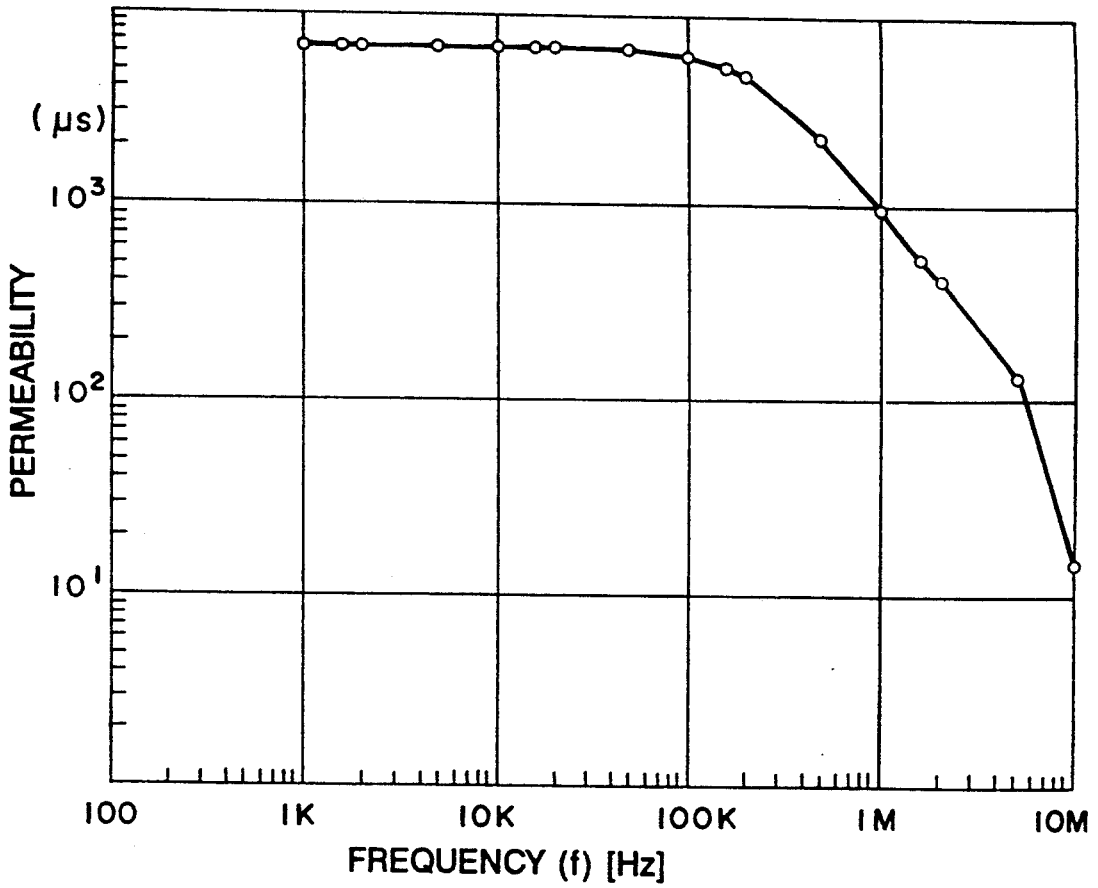
Figure 12:
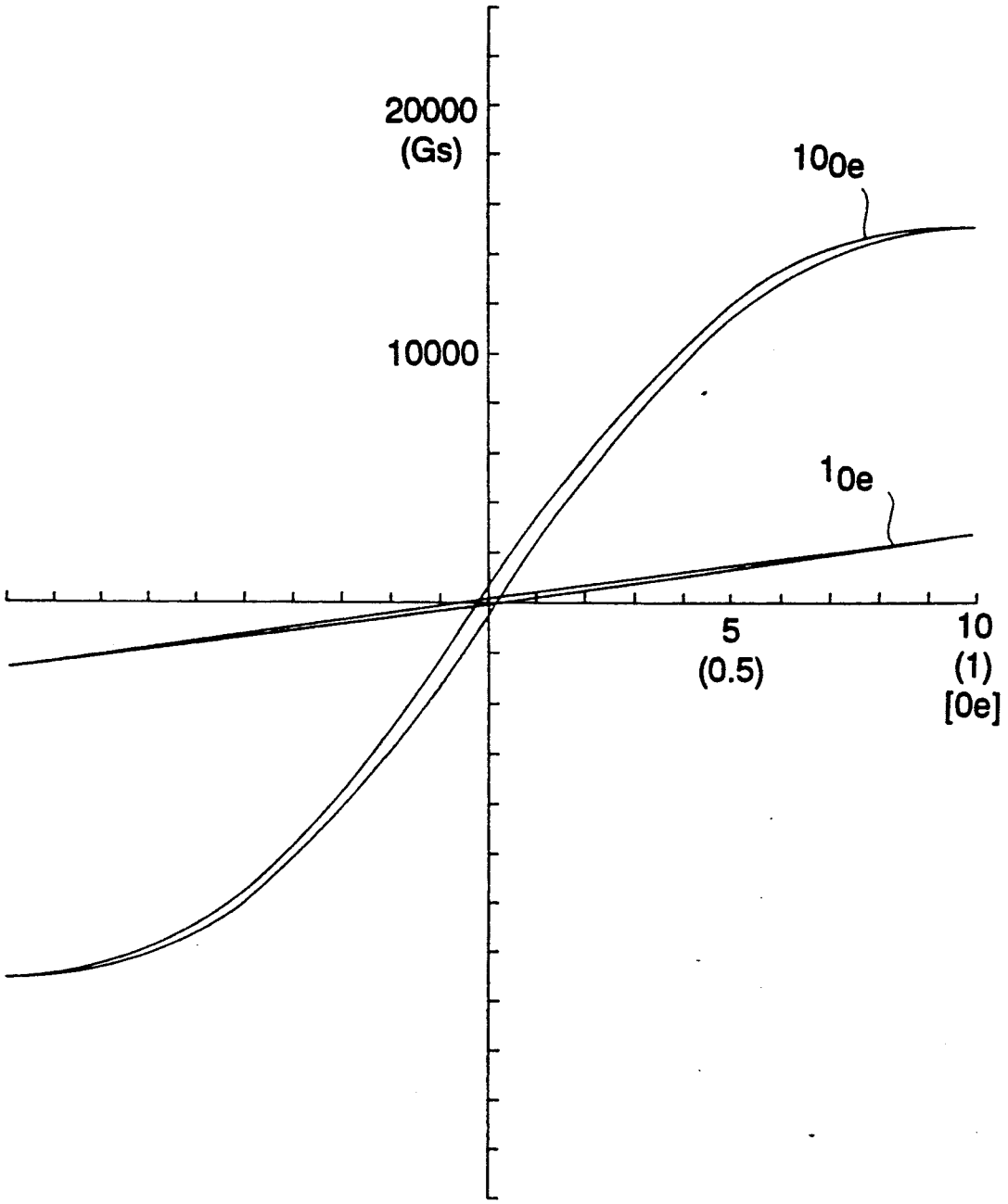
Figure 13:
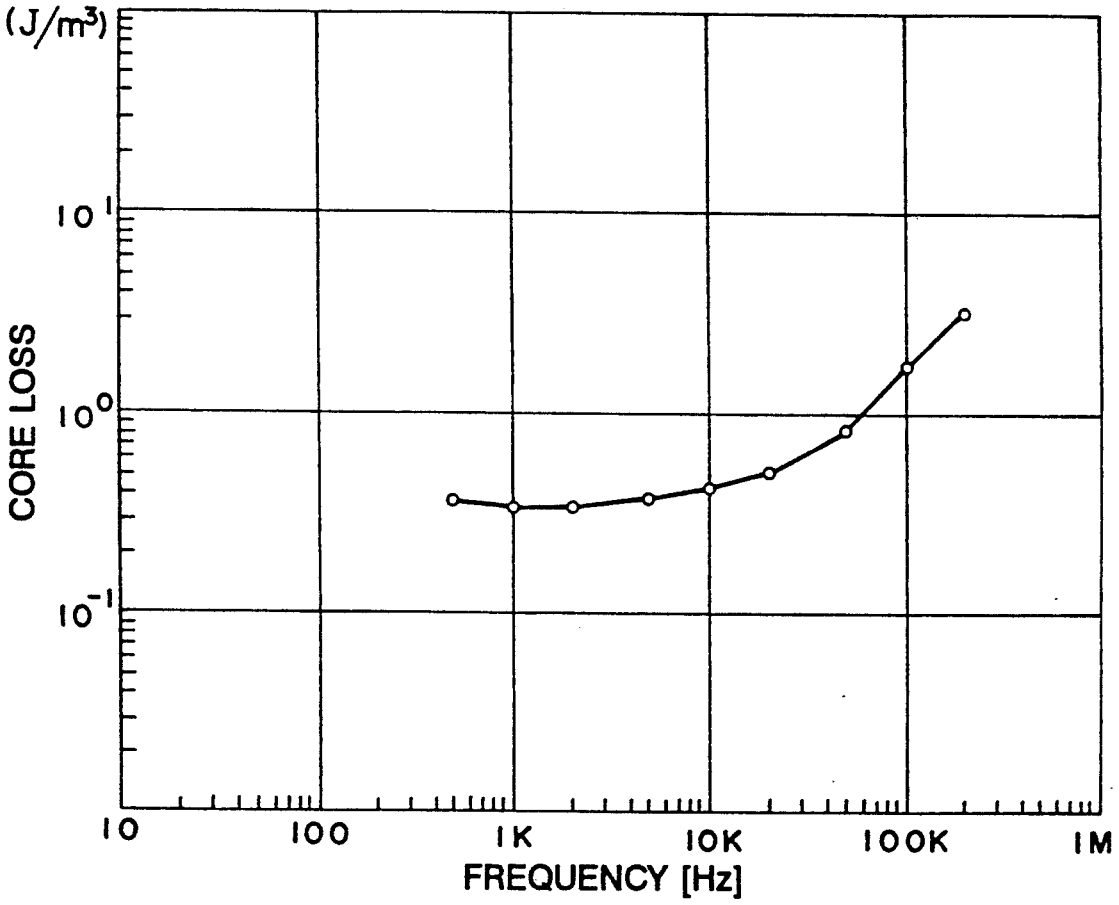
Figure 14:
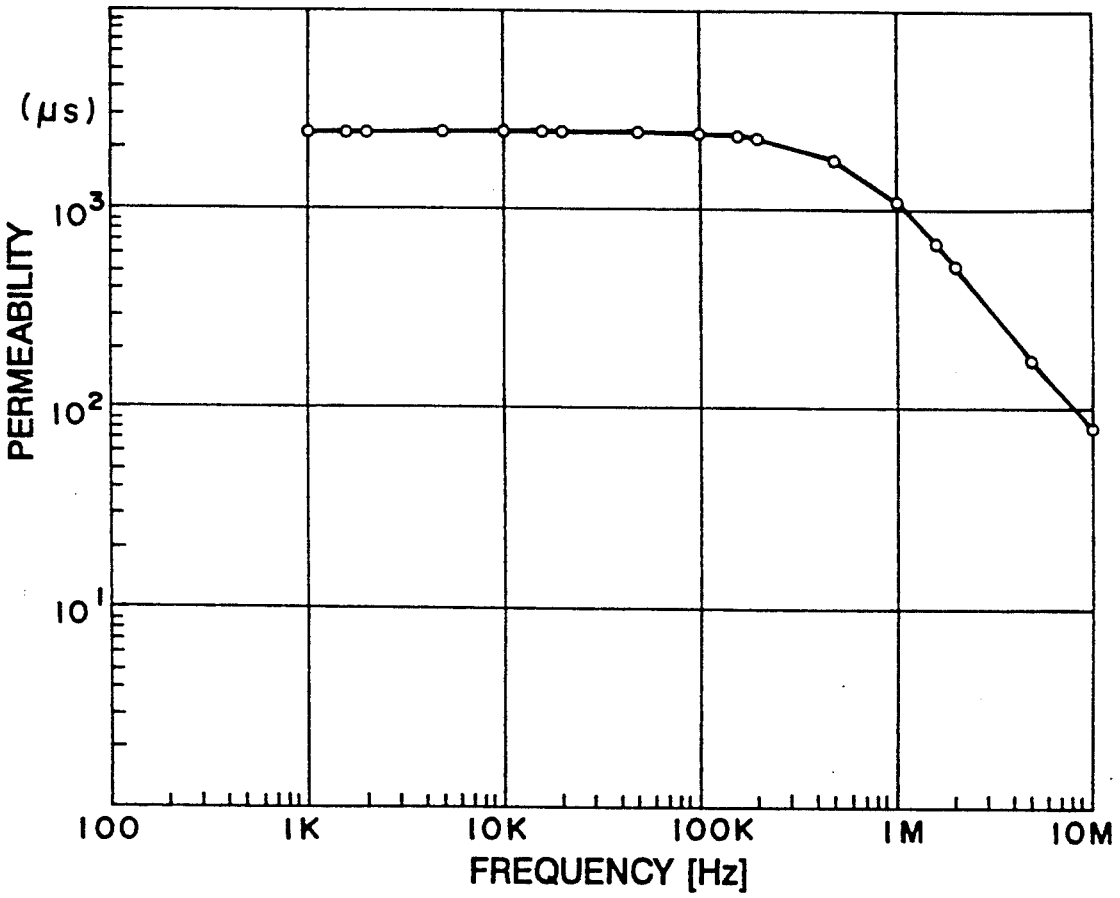

The graphic chart shown in FIG. 11 illustrates the magnetic characteristics in the Example 4, and this figure illustrates the frequency characteristics of permeability of an inductor;

The graphic charts shown in FIGS. 12 to 14 illustrate the magnetic characteristics in the Example 5;

FIG. 12 illustrates B-H characteristics;

FIG. 13 illustrates the frequency characteristics of core loss; and

Figure 15:
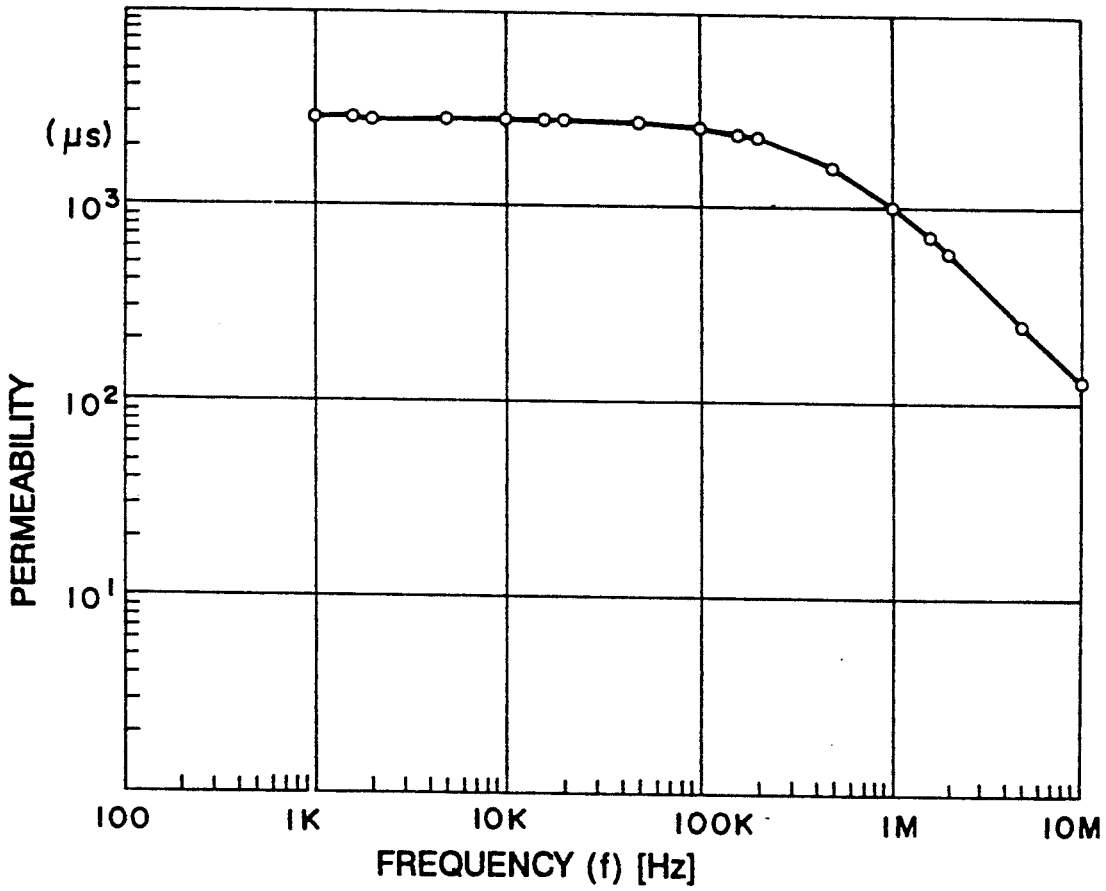

FIG. 14 illustrates the frequency characteristics of permeability;

The graphic chart shown in FIG. 15 illustrates the magnetic characteristics in the Example 6, and this figure illustrates the frequency characteristics of permeability,

DESCRIPTION OF THE PREFERRED EMBODIMENTS

Referring now to the accompanying drawings, a description will be given of the preferred embodiments of the present invention.

The magnetic ribbon referred to in the present invention is a thin magnetic strip, and, as magnetic materials, it is possible to cite the following: ferromagnetic elements such as Fe, Co, and Ni among transition metals, alloys of ferromagnetic elements, alloys of ferromagnetic elements and nonferromagnetic elements which are added to improve characteristics, ferrite, permalloy, amorphous alloys, etc. As amorphous alloys, it is possible to cite Fe-based alloys such as Fe-B, Fe-B-C, Fe-B-Si, Fe-B-Si-Cr, Fe-Co-B-Si, and Fe-Ni-Mo-B, Co-based alloys such as Co-B, Co-Fe-Si-B, Co-Fe-Ni-Mo-B-Si, Co-Fe-Ni-B-Si, Co-Fe-Mn-B-SI, Co-Fe-Mn-Ni, Co-Mn-Ni-B-Si, and Co-Fe-Mn-Ni-B, and other similar alloys.

As magnetic materials used in the present invention in addition to the aforementioned, it is also possible to cite initially amorphous magnetic materials whose structure contains fine crystal particles after heat treatment, such as Fe-Cu-Nb-Si-B alloys, more particularly $Fe_{73.5}$-$Cu_1$-$Nb_3$-$Si_{13.5}$-$B_9$.

The conditions of inorganic fine particles that are attached to such a magnetic ribbon are that it is nonmagnetic, and that it has insulating properties. If the fine particles are magnetic and conductive, an adverse effect is exerted on magnetic characteristics, and an eddy current is liable to flow.

As inorganic substances used in the present invention, it is possible to cite the following: (1) inorganic substances which are stable in a natural condition, including glass (sodium silicate), mica (aluminosilicate alkali salt and phyllosilicate alkali salt), silicon carbide, calcium sulfate semi-water salt, potassium carbonate, magnesium carbonate, calcium carbonate, barium sulfate, and the like; (2) metal oxides such as aluminum oxide (alumina), boron oxide, magnesium oxide, silicon dioxide (silica), tin dioxide, zinc oxide, zirconium dioxide (zirconia) titanium oxide, antimony pentaoxide (diantimony pentaoxide), antimony trioxide and the like; and (3) ceramics formed of the materials cited in (2) above and double oxides such as perovskite, silicate glass, phosphate, titanic acid salt, niobium, tantalum, and tungstate; ceramics formed singly or in a combination by using such ceramic materials as nitrides, including aluminium nitride, a sintered body of aluminium oxide and nitride, boron nitride, boron nitride magnesium, boron nitride complexes, silicon nitride, silicon nitride lanthanum, and SIALON, carbides, including boron carbide, silicon carbide, boron carbide aluminium, and titanium carbide, and borides, including titanium diboride, calcium hexaboride, and lanthanum hexaboride. Among these substances, antimony pentaoxide and/or antimony trioxide is preferably used.

As for the size of the fine particles of the inorganic substance, if consideration is paid to the fact that the fine particles are attached to the ribbon uniformly so as to form an insulating layer, the size of the fine particles may be small. However, if the particle size is made too small, it constitutes a factor making manufacture difficult. Meanwhile, if the particles size is too large, when the magnetic core is formed by a ribbon, the gap between the adjacent layers of the ribbon becomes too large, so that the space factor of the magnetic material becomes small. For this reason, it is preferred that the size of the fine particles is set in the range of 10 nm to 2 μm.

In addition, as for the amount of the fine particles attached, the fine particles may preferably be attached in such a manner that they are attached by $10^{-7}$ $cm^3$ to $2\times10^{-4}$ $cm^3$, more preferably $3\times10^{-6}$ $cm^3$–$10^{-5}$ $cm^3$, per unit area (1 $cm^2$). If this amount attached is calculated into the weight of fine particles per unit area, although its value changes depending on the specific weight of the material of the fine particles, in the case of antimony pentaoxide, the weight is $3.8\times10^{-7}$ $g/cm^2$–$7.6\times10^{-4}$ $g/cm^2$, preferably $1.1\times10^{-5}$ $g/cm^2$–$3.8\times10^{-5}$ $g/cm^2$.

Means for attaching the fine particles is so arranged that these fine particles are dispersed in water or a volatile organic solvent such as toluene, and, after this solution is applied to the ribbon surface, force or natural drying is carried out, thereby allowing the fine particles to be attached to the ribbon. The concentration of this solution determines the amount of fine particles to be attached to the ribbon. In other words, in the case of antimony pentaoxide, this inorganic substance may be dispersed in toluene in a colloidal state at a rate of from 0.1 to 30 wt % with respect to toluene. 3 wt % or thereabouts in this range is also effective, a decline in the space factor is practically nil, and the magnetic characteristics do not deteriorate. The thickness of the film of the solution applied is preferably 10 μm or less in determining the aforementioned amount of fine particles to be attached. In addition, a drying furnace may be used for evaporation of the solvent depending on the solvent, and drying may be carried out at 100° C. or above.

In the present invention, a dispersed system obtained by dispersing said fine particles in a high molecular solution, a high molecular weight compound (hereinafter referred to as "polymer") solution, a polymer dispersion or the mixture thereof, and in particular a colloidal insulation treatment liquid may be also applied at least to one surface of the magnetic ribbon.

The polymer solution used in such an insulation treatment liquid is composed of dissolved polymers in a volatile liquid. As volatile liquids, for example, it is possible to cite water, ammonia water and others as inorganic solvents, and to cite toluene, xylene, lower alcohol, gasoline, kerosine and hexane as organic solvents. In addition thereto, aromatic and aliphatic organic solvents can be cited. These solvents may be used individually or mixed within limits allowed.

The polymer solution dissolved in such a volatile solvent is preferably a nonionic substance which does not coagulate said fine particles substantially in a dispersed system. For example, it is possible to cite polyethylene glycol, carboxymethylcellulose, polyvinyl alcohol, polyacrylic acid, polymethylacrylate, and copolymer of acrylic acid-silicon compound. In addition thereto, it is also possible to cite an acrylate polymer, polyurethane, epoxy resin and polyvinyl acetate.

However, the practically used polymer is selected according to the volatile liquid used therewith, and is preferably one which remains adhesive even after the volatile liquid had volatilized. When toluene is used as a volatile liquid, for example, it is possible to cite an acrylate polymer, polyurethane or epoxy resin. When water is used as a volatile liquid, polyethylene glycol or polyvinyl alcohol is preferable.

The polymer may be used at a rate of 0.1 to 10 wt % with respect to the whole dispersed system. When the rate of the polymer lies in this range, an appropriate viscosity is given to the dispersed system.

The polymer dispersed liquid used in the insulation treatment liquid may use the same volatile liquid as used in said polymer solution as a dispersion medium. As polymers dispersed in such a volatile liquid, it is possible to cite fine particles of polyolefin resins such as those of thermoplastic elastomer, low density polyolefin, ionomer, vinyl acetate copolymer polyolefin and low molecular weight polyolefin. The size of these resin fine particles is preferably 5 μm or less, and their dispersed amount in a volatile liquid is preferably about 0.1 to 10 wt %.

And more particularly, it is possible to cite the following: (1) a polymer dispersed liquid wherein 5 wt % of thermoplastic elastomer fine particles having a mean size of 4 μm are dispersed in water (95 wt %), (2) a polymer dispersed liquid wherein 5 wt % of low density polyolefin fine particles having a mean size of 5 μm or less are dispersed in water (95 wt %), (3) a polymer dispersed liquid wherein 10 wt % of ionomer fine particles having a mean size of 0.5 μm or less are dispersed in water (95 wt %), (4) a polymer dispersed liquid wherein 5 wt % of vinyl acetate copolymer polyolefin fine particles having a mean size of 5 μm or less are dispersed in water (95 wt %), and (5) a polymer dispersed liquid wherein 5 wt % of low molecular weight polyolefin fine particles having a mean size of 2~5 μm or less are dispersed in water (95 wt %).

And the aforementioned polymer solutions and polymer dispersed liquids may contain additives such as a surface active agent, an emulsifying auxiliary and a dispersing auxiliary. And a mixture of a polymer solution and a polymer dispersed liquid may be used.

The rate of the fine particles dispersed in such a polymer solution, a polymer dispersed liquid or a mixture thereof varies very much according to the type of the used polymer solution, polymer dispersed liquid or fine particles, but generally the fine particles may be used at a rate of 0.1 to 60 wt % with respect to the whole dispersed system. In particular, for example, when using diantimony pentaoxide as fine particles and toluene as a volatile liquid, diantimony pentaoxide may be used at a rate of 0.1 to 30 wt % with respect to the whole dispersed system. Diantimony pentaoxide is sufficiently effective for example at a rate of 3 wt %, and when such an insulation treatment liquid is applied to a magnetic ribbon, a magnetic core on which an insulation layrer is formed shows a practically nil space factor, and the magnetic characteristics thereof do not deteriorate.

When preparing an insulation treatment liquid, for example, either of a dispersion method or a cohesion method may be uses as method of dispersing fine particles. In case of a dispersion method, any of a mechanical dispersion method, an electrical dispersion method or a deflocculation method may be used. In case of a cohesion method, any of a reduction method, an oxidation method, a double composition method or a solubility lowering method may be used.

In order to obtain an insulation treatment liquid, a dispersed system may be prepared by using a polymer solution or a polymer dispersed liquid with which a polymer compound has been already mixed, and this dispersed system may be used as an insulation treatment liquid, or the aforementioned fine particles may be mixed in the process of preparing a polymer solution or a polymer dispersed liquid. A polymer compound may be dissolved or dispersed in a volatile liquid in which fine particles are dispersed.

In applying an insulation treatment liquid to the aforementioned magnetic ribbon, the thickness of an applied film may be 10 μm or less.

Usually the magnetic ribbon to which an insulation treatment liquid is applied as described above, dried forcibly or naturally, a volatile liquid is vaporized, and fine particles are attached to the magnetic ribbon by means of a remaining polymer.

In order to vaporize a volatile liquid, a drying furnace is preferably used, and generally drying may be carried out at a temperature of 100° C. or less.

When the aforementioned insulation treatment liquid is applied to a magnetic ribbon, and the magnetic ribbon is annearled, a polymer is burned out, and insulating fine particles are retained as inclusions between magnetic ribbon layers.

With respect to the magnetic ribbon, or an amorphous ribbon, or a magnetic core obtained by winding or laminating the magnetic ribbon or an amorphous ribbon thereon, in particular, annealing may be carried out for 0.5~5 hours, preferably for 2 to 4 hours at a temperature of 300°~600° C., preferably 300° to 500° C., and more preferably 320° to 435° C. in an inert gas atmosphere such as nitrogen or oxygen-containing gas such as oxygen or air so as to eliminate strain, i.e., residual internal stress at the time of production as required. This annealing may be effective after the ribbon is wound or laminated into a magnetic core, or may be effected in the state of the ribbon. In particular, when annealing is effected at a temperature 10° to 50° C. higher than the Curie point, a magnetic core exhibiting excellent characteristics with respect to high frequencies can be obtained. Incidentally, annealing may be effected in a magnetic field or in a nonmagnetic field.

In addition, when the amorphous magnetic core with the ribbon wound therearound or laminated thereon is annealed, since the fine particles disposed between adjacent ribbon layers are powders, the magnetic core is not subjected to linear expansion. The fine particles rather exhibit the action of absorbing the stress accompanying the shrinkage of the amorphous ribbon.

On the basis of the foregoing, a description will now be given one embodiment of a method of producing a magnetic core in accordance with the present invention.

First, a magnetic ribbon and a solution containing fine particles are prepared. The solution containing the fine particles is applied to at least one surface of the magnetic ribbon by any of the various methods of application, and the solvent is allowed to dry. The resultant magnetic ribbon with the fine particles attached thereto is wound under tension, thereby obtaining a toroidal-type magnetic core. Finally, annealing for eliminating strain is carried out, as necessary. Incidentally, tension applied at the time of winding is preferably 0.05 kg or more, more preferably 0.5 kg or more, and further more preferably 0.5 to 2 kg.

Meanwhile, when a laminated type magnetic core is produced, the ribbon with fine particles attached thereto is cut into a predetermined configuration, and the cut pieces are laminated so as to form the magnetic core.

At this time the laminating pressure may be 0.05 $kg/cm^2$ or more, and preferably 0.5 $kg/cm^2$ or more. Annealing which is carried out as necessary may be effected prior to the lamination or after the magnetic core has been formed subsequent to the lamination.

According to the present invention, a magnetic core may be obtained not only by attaching an insulation treatment liquid, i.e., nonmagnetic inorganic fine particles to the magnetic ribbon and winding or laminating the magnetic ribbon into a magnetic core thereafter, but also by winding or laminating a magnetic ribbon while distributing fine particles or a insulation treatment liquid with these fine particles thereover.

As described above, in accordance with the present invention, since the above-described arrangement is adopted, it is possible to improve the magnetic characteristics at a frequency of higher than 10 kHz, and the space factor can be made as large as possible, thereby making contributions to making the magnetic core compact. The magnetic core according to the present invention has various uses, and in particular, may be used preferably for such purposes as choke coils, inductors (for example, common mode choke noise filters), transformers and magnetic amplifiers.

When using a magnetic coil according to the present invention for choke coils, a magnetic gap is preferably formed in the magnetic core.

Before forming the gap, the magnetic core may be impregnated with resin, or resin may be solidified around the magnetic core. In the present invention it is not required rigidly to retain a layer of air. The characteristics advantage of the presence of fine particles is, as described above, that no strains because of the differences of linear expansion are imposed on the magnetic ribbon in annealing the magnetic core, and that the distance between the ribbons are kept as narrow as possible. Accordingly, the magnetic core may be impregnated with resin after annealing.

EXAMPLE 1

Examples of the present invention will be described hereafter.

Figure 7:
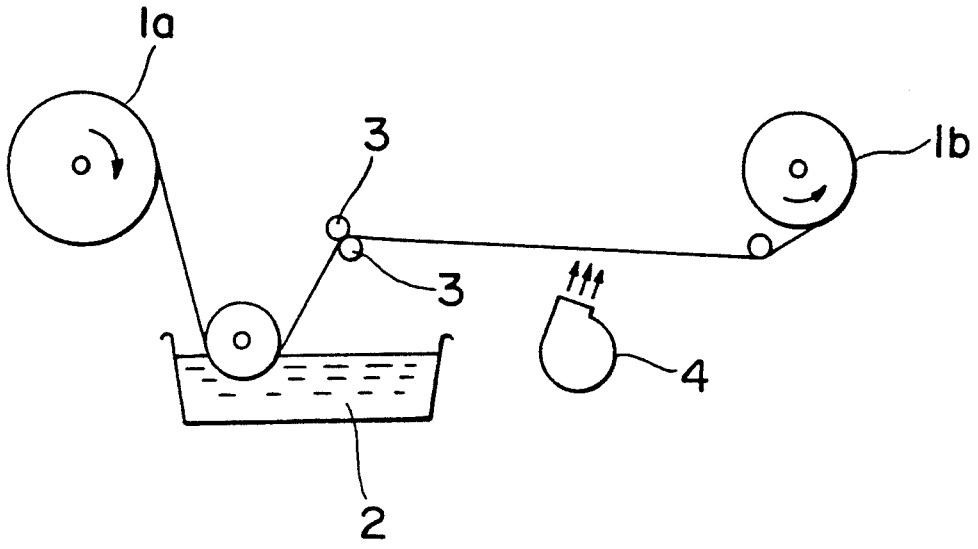
FIG. 7 illustrates the outline of apparatus for attaching fine particles.

By using the apparatus shown in FIG. 7, an amorphous ribbon 1*a* (2605S-2, $Fe_{78}$-$B_{13}$-$Si_9$, 10 mm width) made by Allied Corp. is fed forward into a colloidal solution 2 of antimony pentaoxide (diantimony pentaoxide). When the amorphous ribbon 1*a* is lifted up, the amorphous ribbon 1*a* is clamped by a pair of bar coaters 3 so as to allow excess solution to drop. Then, while the ribbon 1*a* is being dried with hot air by means of a hot air drier 4, the ribbon 1*a* was taken up. As for the colloidal solution 2 of antimony pentaoxide, toluene was used as the solvent, and 3 wt % of antimony pentaoxide was dispersed with respect to toluene 97 wt %.

Figure 8:
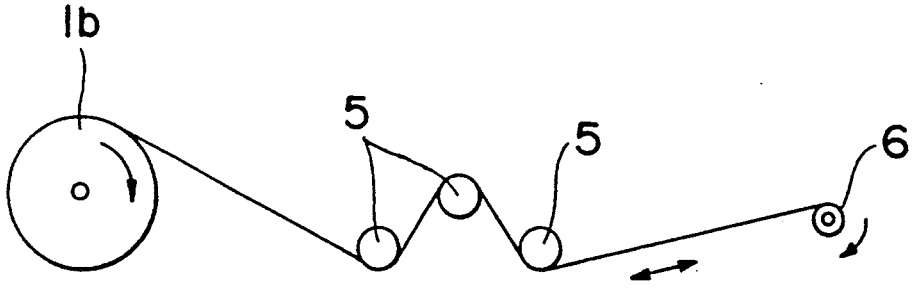
FIG. 8 is a diagram schematically illustrating means for producing a toroidal type magnetic core; and The graphic charts shown in FIG. 9 to 10 illustrate the magnetic characteristics in the Example 3.

Subsequently, as shown in FIG. 8, the ribbon 1*b* with the particles attached thereto was fed forward via a roller 5, and was wound under tension in a final stage, thereby forming an amorphous magnetic core 6. A plurality of magnetic cores having the same dimensions were then formed, and were subjected to annealing for two hours at 435° C. in a nitrogen atmosphere.

With respect to the magnetic cores thus obtained, measurements were made of the B-H characteristics, frequency characteristics of core loss, and frequency characteristics of permeability. As for the B-H characteristics, measurements were made of two cases: one in which a magnetic field of 10 oersted (Oe), and the other in which a magnetic field of 1 oersted (Oe) was applied.

In addition, a colloidal solution in which 30 wt % of antimony pentaoxide was dispersed with respect to 70 wt % of toluene was applied to the ribbon 1*a*, and measurements were similarly made. The detailed conditions in the respective examples were as follows:

(1) Experimental Example 1 (3 wt % solution)

(a) Magnetic core: a toroidal core with the aforementioned ribbon wound therearound
Inside diameter: 23.00 mm
Outside diameter: 37.00 mm
Height: 10.00 mm
Mass: 42.00 g
Density of the material: 7.18 g/m$^3$
Volume: $5.850\times10^{-6}$ (m$^3$)
Effective sectional area: $6.207\times10^{-5}$ (m$^2$)
Mean magnetic path length: $9.425\times10^{-2}$ (m)
Space factor: 88.67% (ratio of the volume of the ribbon to the total volume)
Tension during the magnetic ribbon winding: 0.8 kg (b) Colloidal solution applied
Organic solvent: toluene, 100 wt %
Fine particles: antimony pentaoxide, 3 wt %

Figure 1:
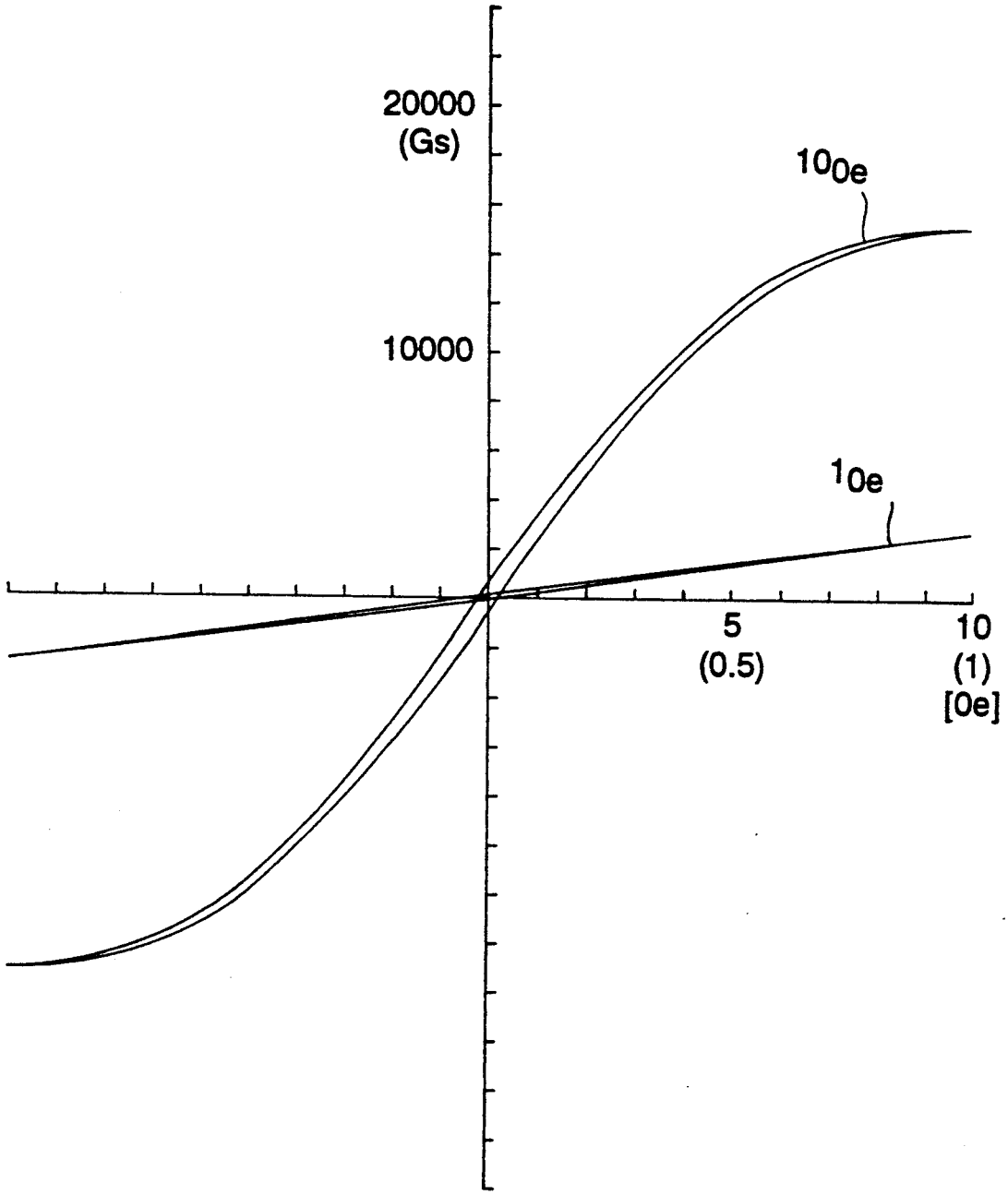
FIG. 1 illustrates B-H characteristics.
Figure 2:
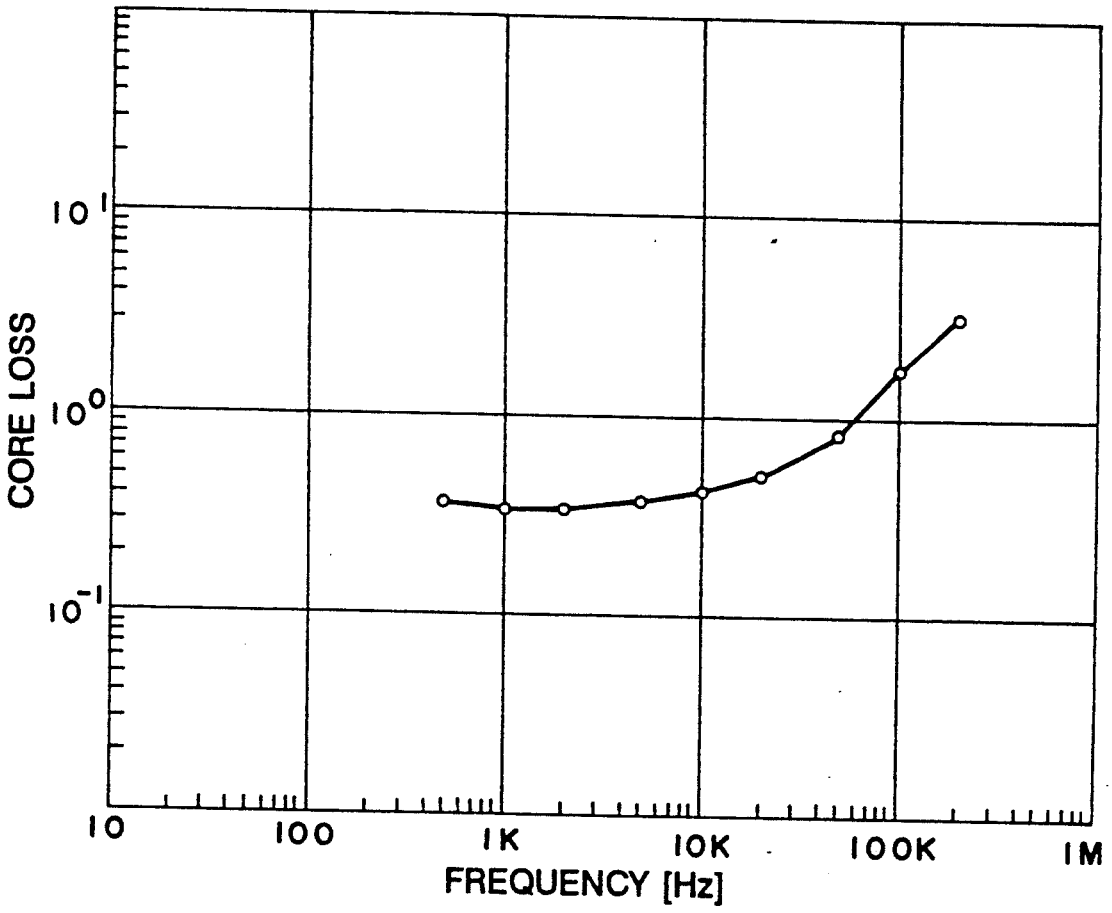
FIG. 2 illustrates the frequency characteristics of core loss.
Figure 3:
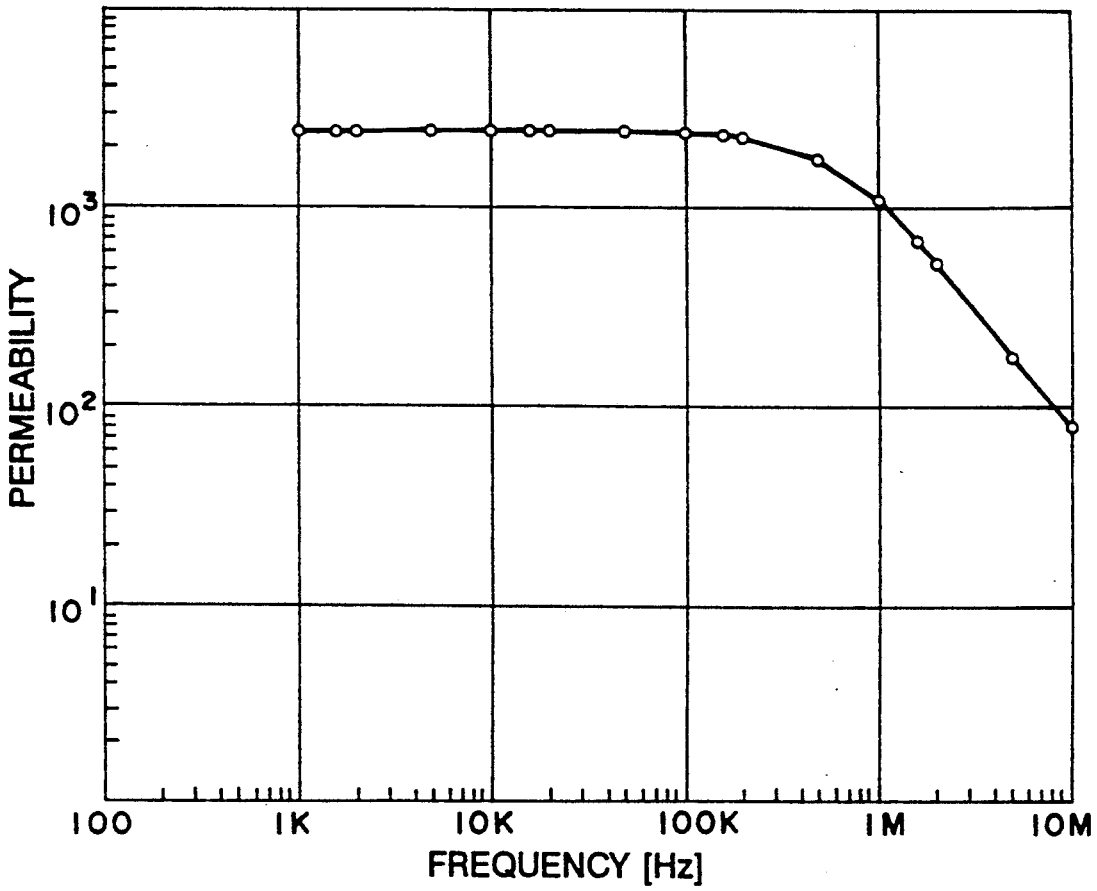
FIG. 3 illustrates the frequency characteristics of permeability.

(c) Results
B-H characteristics are shown in FIG. 1.
Frequency characteristics of core loss are shown in FIG. 2.
The number of turns of the primary winding around the core was 5, while the number of turns of the secondary winding was 10.
Frequency characteristics of permeability are shown in FIG. 3.
The number of turns of the primary winding around the core was 10.
Measured magnetic field: 5 mOe
Measured current: 2.65 mA (2) Experimental Example 2 (30 wt % solution)

(a) Magnetic core: a toroidal core with the aforementioned ribbon wound therearound
Inside diameter: 23.00 mm
Outside diameter: 37.00 mm
Height: 10.00 mm
Mass: 25.57 g
Density of the material: 7.18 g/m$^3$
Volume: $3.561\times10^{-6}$ (m$^3$)
Effective sectional area: $3.779\times10^{-5}$ (m$^2$)
Mean magnetic path length: $9.425\times10^{-2}$ (m)
Space factor: 53.98%
Tension during the magnetic ribbon winding: 0.8 kg (b) Colloidal solution applied
Organic solvent: toluene, 70 wt %
Fine particles: antimony pentaoxide, 30 wt %

Figure 4:
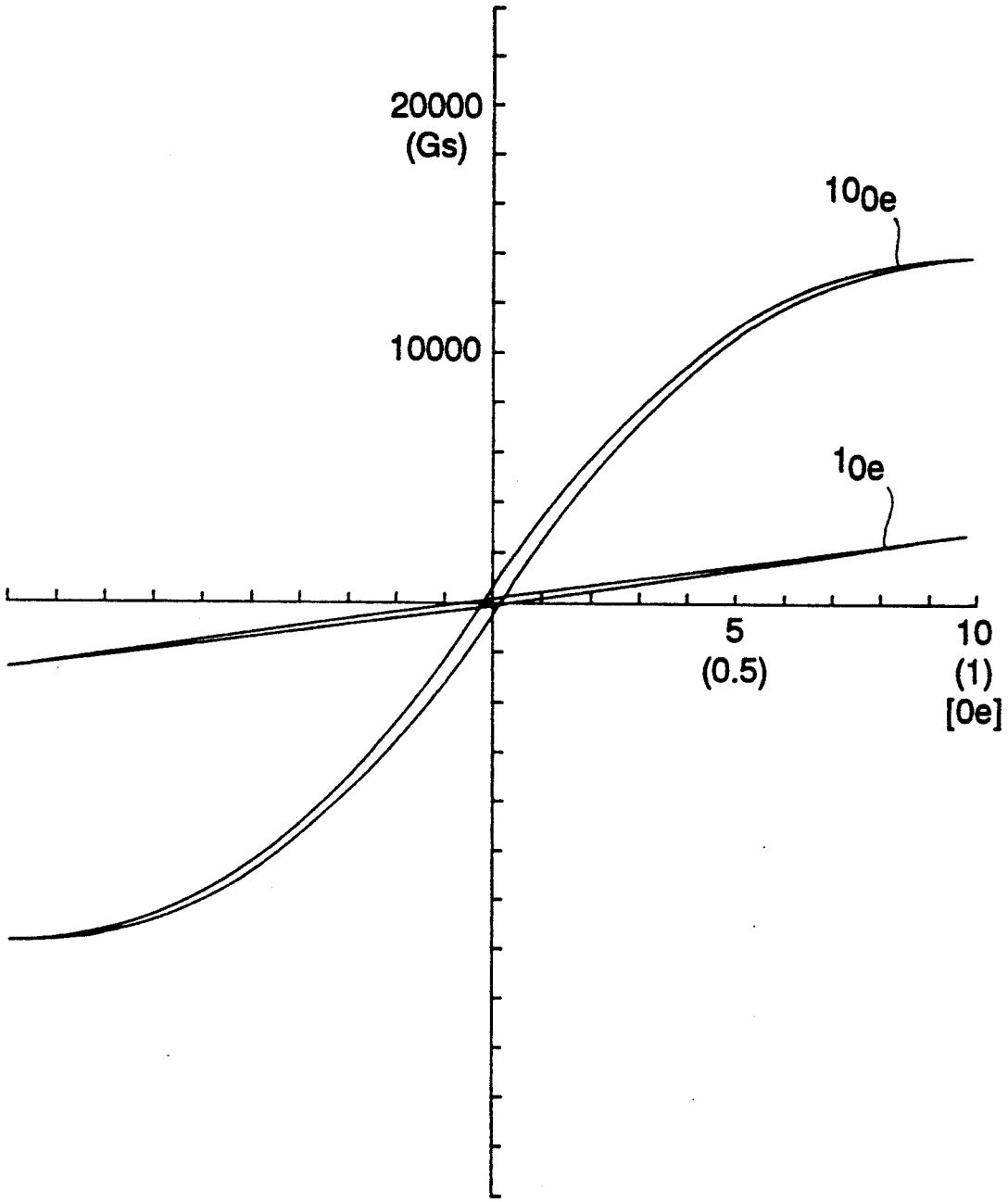
FIG. 4 illustrates B-H characteristics.
Figure 5:
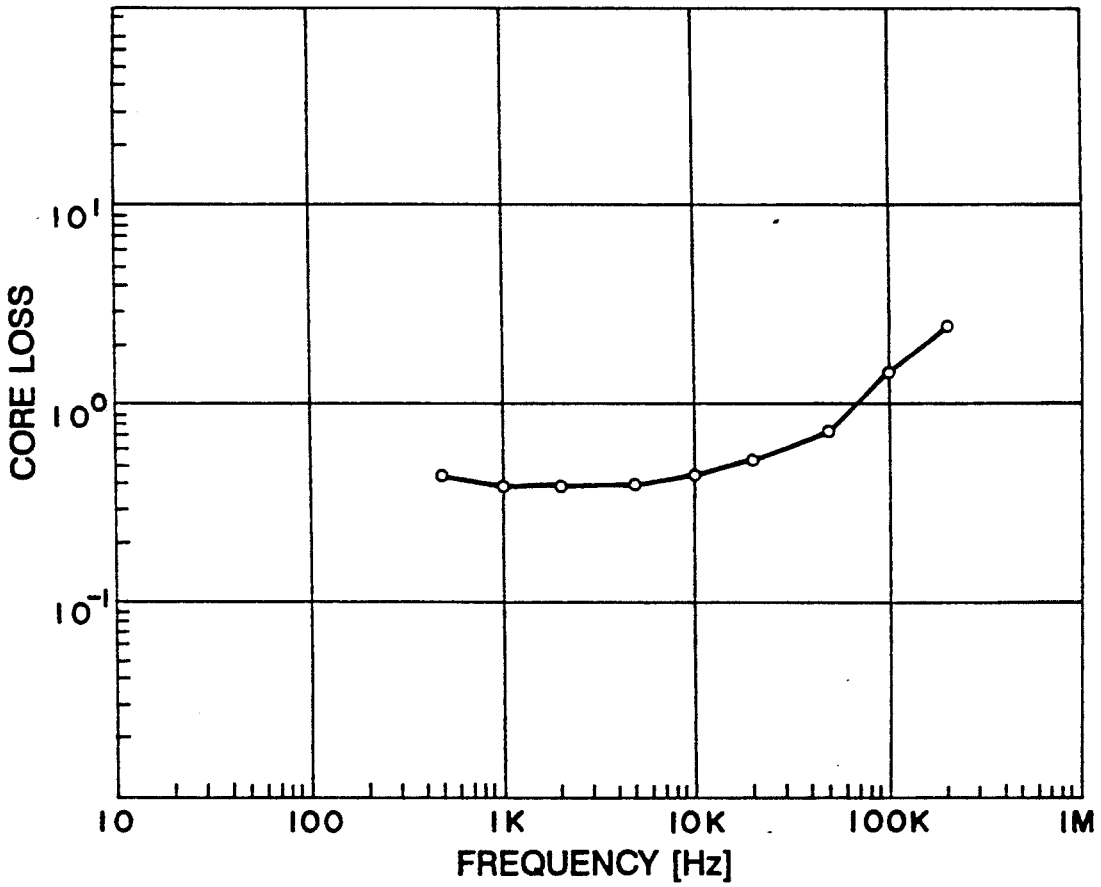
FIG. 5 illustrates the frequency characteristics of core loss.
Figure 6:
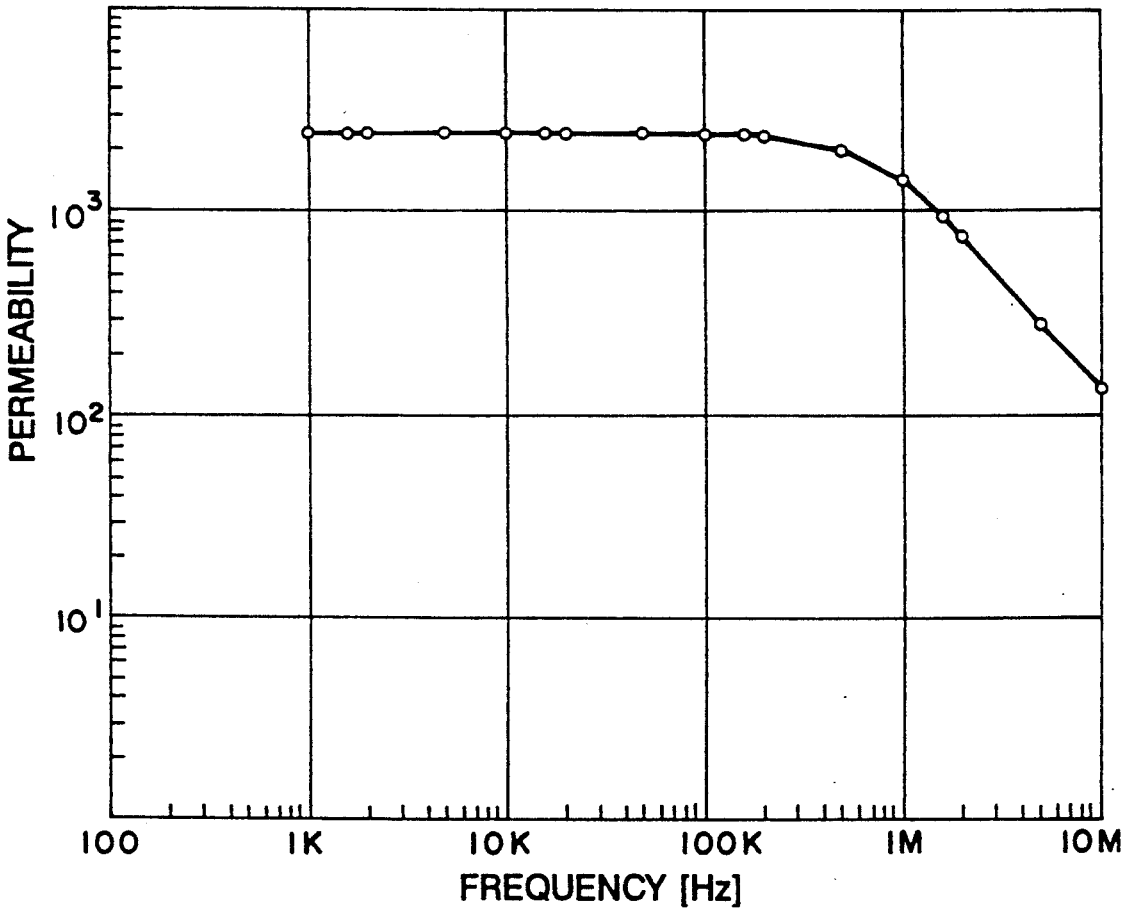
FIG. 6 illustrates the frequency characteristics of permeability.

(c) Results
B-H characteristics are shown in FIG. 4.
Frequency characteristics of core loss are shown in FIG. 5.
The number of turns of the primary winding around the core was 5, while the number of turns of the secondary winding was 10.
Frequency characteristics of permeability are shown in FIG. 6.
The number of turns of the primary winding around the core was 10.
Measured magnetic field: 5 mOe
Measured current: 2.65 mA From the foregoing results, it can be appreciated that the magnetic cores of the Examples display a hysteresis which is closer to a linear configuration, and that the core loss is low as a whole, and a rise in the high-frequency component can be reduced to a low level. A substantially fixed permeability was obtained up to 200 kHz.

As described above, in accordance with the present invention, since the above-described arrangement is adopted, it is possible to improve the magnetic characteristics at a frequency higher than 10 kHz, and the space factor can be made as large as possible, thereby making contributions to making the magnetic core compact.

EXAMPLE 2

A colloidal solution of 60 wt % of water and 40 wt % of dispersed diantimony pentaoxide fine particles (size: 0.04 μm) was applied to one surface of an amorphous magnetic ribbon (15 mm width) of 2605S-2 ($Fe_{78}$-$B_{13}$-$Si_9$) made by Allied Corp. by means of a roll coater, and an insulation layer of 0.4 μm thickness was formed.

Subsequently, this amorphous magnetic ribbon was wound with a winding tension of 0.8 kg, thereby obtaining a toroidal core with an outside diameter of 37 mm, an inside diameter of 23 mm, a height of 15 mm and a space factor of 90%.

And the toroidal core thus obtained was subjected to annealing for two hours at 385° C. in a nitrogen atmosphere, and then it was vacuum-impregnated with epoxy resin (2287 made by Three Bond) (for 30 minutes). As drying conditions of epoxy resin 120° C. two hours+150° C. two hours were adopted. In this toroidal core a magnetic gap having a porosity of 1.0 mm was formed by means of a rotating grindstone (edge thickness: 0.8 mm). Then the toroidal core was put in an insulation case, and 40 turns of an insulation-coated conductor with a diameter of 1.0 were wound therearound.

With respect to the choke coil thus obtained, measurements were made of the core loss with f=100 [kHz] and Bm=0.1 [T], thereby obtaining a value of 160 [W/kg].

EXAMPLE 3

Experimental Example

A colloidal solution of 97 wt % of toluene and 3 wt % of dispersed diantimony pentaoxide fine particles (size: 0.04 μm) was applied to one surface of an amorphous magnetic ribbon (25 mm width) of 2605S-2 ($Fe_{78}$-$B_{13}$-$Si_9$) made by Allied Corp. by means of a spray, and an insulation layer of 0.04 μm thickness was formed.

Subsequently, this amorphous magnetic ribbon was wound with a winding tension of 0.8 kg, thereby obtaining a toroidal core with an outside diameter of 50 mm, an inside diameter of 25 mm, a height of 25 mm and a space factor of 84%.

And the toroidal core thus obtained was subjected to annealing for two hours at 430° C. in a nitrogen atmosphere. This treatment was carried out without a magnetic field. Then the toroidal core was put in an insulation case, and 20 turns of an insulation-coated conductor with a diameter of 0.5 were wound therearound as the primary winding, and 10 turns as the secondary winding, thereby obtaining a transformer.

Figure 9:
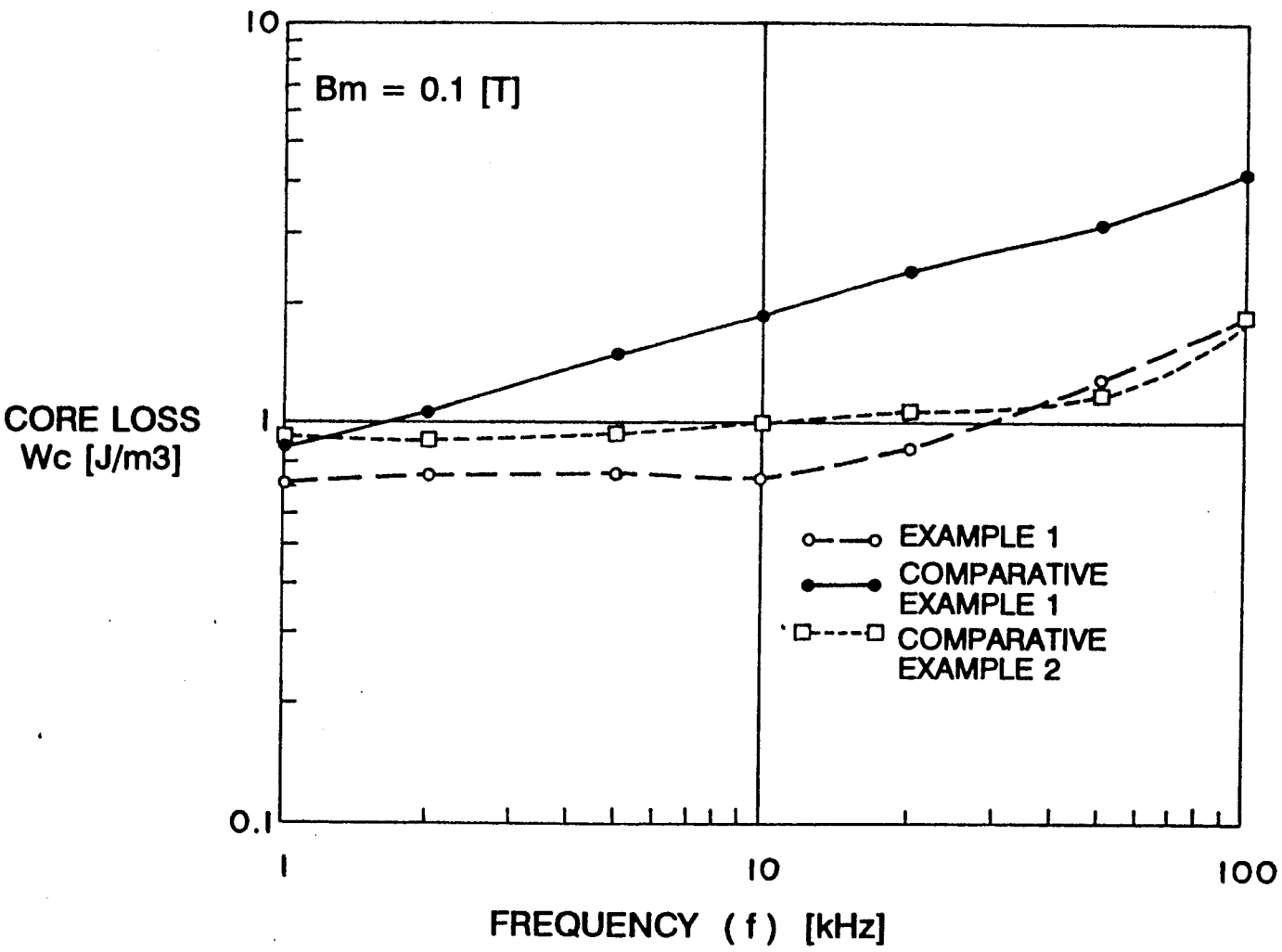
FIGS. 9 and 10 illustrate the frequency characteristics of core loss respectively.
Figure 10:
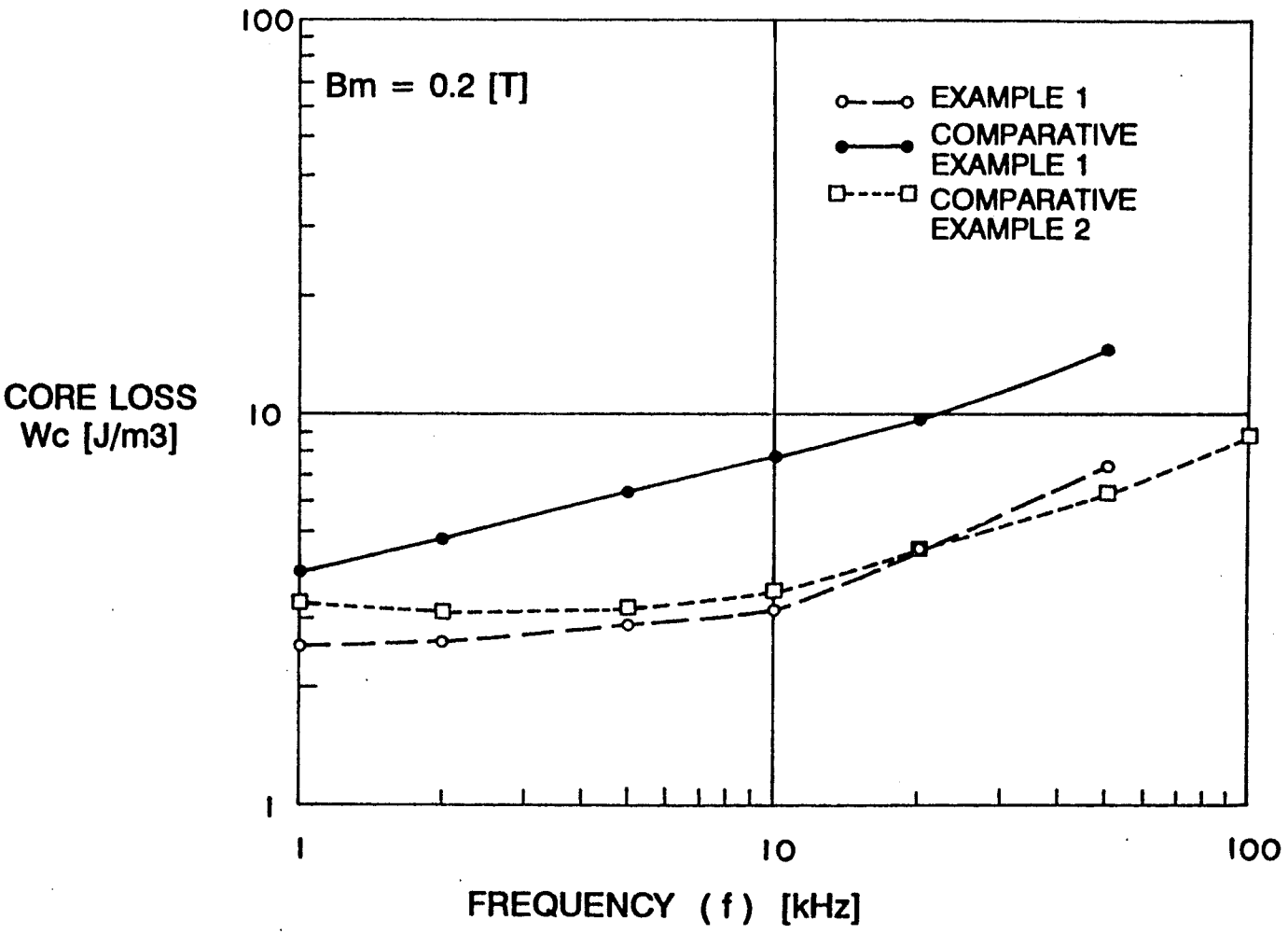

With respect to the transformer thus obtained, measurements were made of the direct current hysteresis loss, thereby obtaining the results shown in Table 1. Measurements were also made of the frequency characteristics of core loss, thereby obtaining the results illustrated in FIG. 9 and FIG. 10. FIG. 9 illustrates the characteristics with Bm=0.1 [T], and FIG. 10 illustrates the characteristics with Bm=0.2 [T].

Comparative Example 1

An amorphous magnetic ribbon (20 mm width) of 2605S2 ($Fe_{78}$-$B_{13}$-$Si_9$) made by Allied Corp. was wound with a winding tension of 0.8 kg, thereby obtaining a toroidal core with an outside diameter of 50 mm, an inside diameter of 25 mm, a height of 20 mm and a space factor of 91%. And the toroidal core thus obtained was subjected to annealing for two hours at 430° C. in a nitrogen atmosphere. This treatment was carried out without a magnetic field. Then the toroidal core was put in an insulation case, and 20 turns of an insulation-coated conductor with a diameter of 0.5 were wound therearound as the primary winding, and 10 turns as the secondary winding thereby obtaining a transformer.

With respect to the transformer thus obtained, measurements were made of the direct current hysteresis loss, thereby obtaining the results shown in Table 1. Measurements were also made of the frequency characteristics of core loss, thereby obtaining the results illustrated in FIG. 16 and FIG. 17.

Comparative Example 2

In producing a toroidal core of an amorphous magnetic ribbon (20 mm width) of 2605S-2 ($Fe_{78}$-$B_{13}$-$Si_9$) made by Allied Corp., a perfect insulation layer was formed by rolling in a polyimide tape (25 μm) between ribbon layers simultaneously. Subsequently, this amorphous magnetic ribbon was wound a winding tension of 0.8 kg, thereby obtaining a toroidal core with an outside diameter of 44.5 mm, an inside diameter of 25 mm, a height of 20 mm and a space factor of 33%. And the toroidal core thus obtained was subjected to annealing for two hours at 430° C. in a nitrogen atmosphere. This treatment was carried out without a magnetic field. Then the toroidal core was put in an insulation case, and 20 turns of an insulation-coated conductor with a diameter of 0.5 were wound therearound as the primary winding, and 10 turns as the secondary winding, thereby obtaining a transformer.

With respect to the transformer thus obtained, measurements were made of the direct current hysteresis loss, thereby obtaining the results shown in Table 1.

| | Direct Current Hysterisis Loss Wh [J/m³] | |
|---|---|---|
| BM | 0.1 [T] | 0.2 [T] |
| Experimental Example | 0.574 | 1.76 |
| Comparative Example 1 | 0.613 | 2.54 |
| Comparative Example 2 | 0.535 | 1.86 |

EXAMPLE 4

A colloidal solution of 60 wt % of water and 40 wt % of dispersed diantimony pentaoxide fine particles (size: 0.04 μm) was applied to one surface of an amorphous magnetic ribbon (15 mm width) of 2605S-2 ($Fe_{78}$-$B_{13}$-$Si_9$) made by Allied Corp. by means of a roll coater, and an insulation layer of 0.4 μm thickness was formed.

Subsequently, this amorphous magnetic ribbon was wound with a winding tension of 0.8 kg, thereby obtaining a toroidal core with an outside diameter of 37 mm, an inside diameter of 23 mm, a height of 15 mm, a volume of $8.85\times10^{-6}$ ($m^3$), an effective sectional area of $9.39\times10^{-5}$ ($m^2$), a mean magnetic path length of $9.43\times10^{-2}$ (m) and a space factor of 89.4%.

And the toroidal core thus obtained was subjected to annealing for two hours at 395° C. Then the toroidal core was put in an insulation case, and 10 turns of an insulation-coated conductor with a diameter of 0.5 were wound therearound.

With respect to the inductor thus obtained, measurements were made of the frequency characteristics of permeability with a measured magnetic field of 5 mOe and a measured current of 2.65 mA., thereby obtaining the results illustrated in FIG. 11.

EXAMPLE 5

An amorphous magnetic core was produced by using an insulation treatment liquid A wherein 3 wt % of diantimony pentaoxide with a particle size of 0.01~0.02 μm was dispersed in 2 wt % water solution of polyvinyl alcohol.

That is, by using the apparatus shown in FIG. 7, an amorphous ribbon (1*a*) 2605S-2 ($Fe_{78}$-$B_{13}$-$Si_9$, 10 mm width) was fed forward to apply said insulation treatment liquid A thereto by means of a roll coater, and then the ribbon was coiled.

It was confirmed that diantimony pentaoxide was firmly attached to every amorphous ribbon.

Subsequently, as shown in FIG. 8, the ribbon (1*b*) with the fine particles attached thereto was fed forward via a roller (5), and was wound under tension in a final stage, thereby forming an amorphous magnetic core (6). A plurality of magnetic cores having the same dimensions were then formed, and they were subjected to annealing for two hours at 435° C. in a nitrogen atmosphere.

With respect to the magnetic cores thus obtained, measurements were made of the B-H characteristics, frequency characteristics of core loss, and frequency characteristics of permeability. As for the B-H characteristics, measurements were made of two cases: one in which a magnetic field of 10 oersted (Oe), and the other in which a magnetic field of 1 oersted (Oe) was applied.

The characteristics of the magnetic cores obtained by using the insulation treatment liquid A are illustrated in FIG. 12~FIG. 14. FIG. 12 illustrates the B-H characteristics, FIG. 13 illustrates the frequency characteristics of core loss, wherein the number of turns of the primary winding around the core was 5, while the number of turns of the secondary winding was 10, and FIG. 14 illustrates the frequency characteristics of permeability, wherein the number of turns of the primary winding around the core was 10, while a measured magnetic field of 5 mOe and a measured current of 2.65 mA were applied.

The detailed data of this magnetic core are as follows:

Inside diameter: 23.00 mm
Outside diameter: 37.00 mm
Height: 10.00 mm
Mass: 42.00 g
Density of the material: 7.18 g/cm$^3$
Volume: $5.850\times10^{-6}$ (m$^3$)
Effective sectional area: $6.207\times10^{-5}$ (m$^2$)
Mean magnetic path length: $9.425\times10^{-2}$ (m)
Space factor: 88.67% (ratio of the volume of the ribbon to the total volume)
Tension during the magnetic ribbon winding: 0.8 kg From the foregoing results, it can be appreciated that the magnetic cores produced by using the insulation treatment liquid according to the present invention exhibits a hysteresis which is closer to a linear configuration, and that the core loss is low as a whole, and a rise particularly in the high-frequency component can be reduced to a low level. A substantially fixed permeability was obtained up to 200 kHz. There was also no troubles of powder layers pealing off from the surfaces of a magnetic ribbon in the process of production.

EXAMPLE 6

A colloidal solution of titania with a particle size of 0.04~0.1 μm was applied to the both surfaces of an amorphous ribbon {2605S-2 ($Fe_{78}$-$B_{13}$-$Si_9$, 10 mm width)} by means of a dip coater, thereby forming an insulation layer. The colloidal solution used toluene as solvent, wherein 3 wt % of titania (titanium oxide) was dispersed with respect to 97 wt % of toluene.

By using this ribbon, a coiled magnetic core with an outside diameter of 37 mm, an inside diameter of 23 mm, a height of 10 mm, a volume of $4.20\times10^{-6}$ (m$^3$), an effective sectional area of $4.46\times10^{-5}$ (m$^2$), a mean magnetic path length of $9.43\times10^{-2}$ (m), and a space factor of 64% was formed, subjected to annealing for two hours at 430° C. in a nitrogen atmosphere, and subsequently the magnetic core was put in an insulation case, and 10 turns of a insulation-coated conductor with a diameter of 0.5 was wound therearound. The amorphous ribbon thus obtained exhibited a space factor of 64%. And by means of an impedance analyzer (made by Huelett-Packered, Model-HP4192A) measurements were made of the frequency characteristics of permeability with a measured magnetic field of 5 mOe and a measured current of 2.65 mA. The results of the measurements are illustrated in FIG. 15.

What is claimed is:

1. A magnetic ribbon for winding or lamination into a magnetic core, the magnetic ribbon being formed of an amorphous metal and having coated on at least one surface thereof an aggregation of fine particles of diantimony pentaoxide 10 nm to 2 μm in size formed forming a discontinuous layer having insulating properties, the fine particles being attached to the surface in an amount of $10^{-7}$ cm$^3$ to $2\times10^{-4}$ cm$^3$ per square centimeter of surface area.

2. A magnetic core comprising a lamination obtained by winding or laminating the magnetic ribbon of claim 1 wherein a layer of the fine particles is formed between the adjacent magnetic ribbon layers and an air layer is present therebetween together with said fine particle layer.

3. A magnetic ribbon according to claim 1, wherein said magnetic ribbon is subjected to annealing for 0.5~5 hours at a temperature of 300°~500° C. in an inert gas atmosphere.

4. A magnetic ribbon according to claim 1, wherein said magnetic ribbon is subjected to annealing for 0.5~5 hours at a temperature of 300°~500° C. in an oxygen containing gas.

5. A magnetic core according to claim 2 which is subsequently subjected to annealing for 0.5~5 hours at a temperature of 300°~500° C. in an inert gas atmosphere.

6. A magnetic core according to claim 2 which is subsequently subjected to annealing for 0.5~5 hours at a temperature of 300°~500° C. in an oxygen contain gas atmosphere.

7. A choke coil which comprises a lamination obtained by winding or laminating the magnetic ribbon of claim 1 and which uses the magnetic core of claim 2.

8. A transformer which comprises a lamination obtained by winding or laminating the magnetic ribbon of claim 1 and which uses the magnetic core of claim 2.

9. An inductor which comprises a lamination obtained by winding or laminating the magnetic ribbon of claim 1 and which uses the magnetic core of claim 2.

10. The magnetic ribbon of claim 1 formed from an insulation treatment liquid which comprises a dispersed system wherein said diantimony pentaoxide particles are dispersed in a viscous solution containing a polymer and a volatile liquid, a dispersion containing a polymer and a volatile liquid or a mixture of said solution and said dispersion.

11. The insulation treatment liquid of claim 10 wherein said polymer is selected from the group consisting of polyethylene glycol, carboxymethylcellulose, polyvinyl alcohol, polyacrylic acid, polymethyl acrylate, an acrylic acid-silicon compound copolymer, an acrylate polymer, polyurethane, epoxy resin and polyvinyl acetate.

* * * * *